United States Patent [19]

Ohaku et al.

[11] Patent Number: 4,728,592

[45] Date of Patent: Mar. 1, 1988

[54] ELECTROPHOTOCONDUCTOR WITH LIGHT-SENSITIVE LAYER CONTAINING ALPHA-TYPE TITANYL PHTHALOCYANINE

[75] Inventors: Kenichi Ohaku, Oyama; Hiroshi Nakano, Kitamoto; Masao Aizawa, Hasuda, all of Japan

[73] Assignee: Dainippon Ink and Chemicals, Inc., Tokyo, Japan

[21] Appl. No.: 886,496

[22] Filed: Jul. 17, 1986

[51] Int. Cl.[4] ..... G03G 5/06

[52] U.S. Cl. ..... 430/59; 430/76; 430/78

[58] Field of Search ..... 430/64, 76, 78, 59

[56] References Cited

U.S. PATENT DOCUMENTS

| | | | |
|---|---|---|---|
| 4,031,109 | 6/1977 | Griffiths et al. | 430/76 |
| 4,032,339 | 6/1977 | Grushkin et al. | 430/1 |
| 4,106,935 | 8/1978 | Petruzzella | 430/64 |
| 4,584,253 | 4/1986 | Lin et al. | 430/64 |

FOREIGN PATENT DOCUMENTS 0180930 5/1986 European Pat. Off. .

*Primary Examiner*—John L. Goodrow

*Attorney, Agent, or Firm*—Armstrong, Nikaido, Marmelstein & Kubovcik

[57] ABSTRACT

An electrophotoconductor having a light-sensitive layer characterized in that a titanyl phthalocyanine is dispersed in a binder, said titanyl phthalocyanine having the structure represented by the general formula:

(wherein $X_1$, $X_2$, $X_3$ and $X_4$ each and independently represent Cl or Br; and k, l, m and n each and independently represent 0 or an integer of 1 to 4) and an alpha-type crystallographic form.

31 Claims, 9 Drawing Figures

ELECTROPHOTOCONDUCTOR WITH LIGHT-SENSITIVE LAYER CONTAINING ALPHA-TYPE TITANYL PHTHALOCYANINE

FIELD OF THE INVENTION

Background of the Invention

The present invention relates to an electrophotoconductor and, more particularly, to one which is suitable for use in a printer such as a laser beam printer employing a semiconductor laser.

Prior Art

Since the discovery of the photoconductivity of phthalocyanine compounds in 1968, various studies have been conducted with respect to their use as photoconductive materials. With the recent advances in non-impact printing technology, active efforts are being made to develop laser beam printers which use semiconductor lasers for writing heads. Electrophotography with a laser beam printer starts with the formation of a uniform charged layer on a photoconductor by corona discharge, and after the charged photoconductor has been irradiated with a modulated laser beam in response to an input signal, a visible image is formed by toner development. This laser recording system has the advantages of improved image quality and a reduction in the complexity, size and cost of the printing system by virtue of the use of a semiconductor laser.

Most of the semiconductor lasers available today for stable operation have oscillation wavelengths in the near-infrared region ($\lambda > 780$ nm). This means that photoconductors which are suitable for printing with such semiconductor lasers are required to have high sensitivity in the wavelength region longer than 780 nm. For practical purposes, sensitivities of 10 erg/cm$^2$ or less in terms of E $\frac{1}{2}$ are required, this being the exposure of monochromatic infrared radiation necessary to reduce the charge by half its initial value. While various photoconductive materials are known to exhibit high sensitivity at wavelengths longer than 780 nm, particular attention is being paid to phthalocyanine compounds.

Heretofore, electrophotoconductors have employed inorganic compounds such as selenium, tellurium, cadmium sulfide and zinc oxide, or organic compounds such as poly(N-vinylcarbazole) and bisazo pigments. However, none of these compounds have adequately high photosensitivity in the wavelength region longer than 780 nm. It has recently been reported that photoconductors using alloys containing selenium, tellurium or arsenic or dye-sensitized cadmium sulfide have high sensitivity in the wavelength region up to about 800 nm, but all of these compounds are highly toxic and social concern over environmental hazards has put the safety of these compounds into question. Photoconductors using amorphous silicon are also known and it is held that their sensitivity range can be extended to the longer wavelength region by selection of appropriate doping and production methods. But with the present state of the art, photoconductors using amorphous silicon are not available at low cost because the film of amorphous silicon cannot be deposited at a sufficiently fast rate to realize high-mass production. Among the phthalocyanine compound that have been reviewed and which have been shown to exhibit high sensitivity in the wavelength region longer than 780 nm are included X-type non-metallic phthalocyanine, $\epsilon$-type copper phthalocyanine, vanadyl phthalocyanine, etc.

With a view to attaining higher sensitivity, multilayer photoconductors using a deposited phthalocyanine layer as a charge generation layer have been reviewed and in several cases, comparatively high sensitivities have been attained with phthalocyanine compounds having a metal of group IIIa or IV in the Periodic Table as the central metal.

However, the organic photoconductors of this type are costly because the formation of deposited layers required an expensive evacuation apparatus capable of producing very low ultimate pressures.

A different type of multi-layer photoconductors has also been reviewed; instead of being vacuum-evaporated, in this type phthalocyanine is dispersed in a resin to form a charge generation layer, on which is coated a charge transport layer. Photoconductors of this type use non-metallic phthalocyanine (U.S. Pat. No. 4,507,374) or indium phthalocyanine (U.S. Pat. No. 4,471,039) and both exhibit fairly high photosensitivity. However, the photoconductor using non-metallic phthalocyanine has the disadvantage that its sensitivity drops shaply in the wavelength region longer than 800 nm, and the one using indium phthalocyanine suffers from the disadvantage that the charge generation layer as a resin dispersion system cannot be formed on a commercial scale without sacrificing the sensitivity of the photoconductor.

SUMMARY OF THE INVENTION

The principal object, therefore, of the present invention is to eliminate the aforementioned defects of the prior art products and to provide an electrophotoconductor which exhibits high sensitivity over a broad wavelength range of 500–900 nm, especially in the wavelength region longer than 800 nm.

This object of the present invention can be attained by an electrophotoconductor which has a light-sensitive layer wherein a specified alpha-type titanyl phthalocyanine is dispersed in a binder.

DETAILED DESCRIPTION OF THE INVENTION

The alpha-type titanyl phthalocyanine used in the present invention has the following general formula (I):

(I)

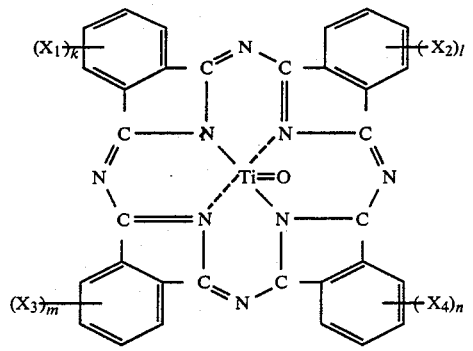

wherein $X_1$, $X_2$, $X_3$ and $X_4$ each and independently represents Cl or Br; and k, l, m and n each and independently represents 0 or an integer of 1 to 4.

Among the compounds of the general formula (I), those which are unsubstituted by any halogen of monohalogen-substituted derivatives are particularly advantageous.

The alpha-titanyl phthalocyanine used in the present invention may be prepared, for example, by the following procedures: Titanium tetrachloride (or titanium tetrabromide) is reacted with phthalodinitrile in the solvent α-chloronaphthalene to form dichlorotitanium phthalocyanine ($TiCl_2Pc$) [for dibromotitanium phthalocyanine ($TiBr_2Pc$)]; it is then hydrolyzed with aqueous ammonia or any other appropriate hydrolyzing agent and the resulting product is treated with an electron-donating solvent such as 2-ethoxyethanol, diglyme, dioxane, tetrahydrofuran, N,N-dimethylformamide, N-methylpyrrolidone, pyridine or morpholine.

Figure 1:
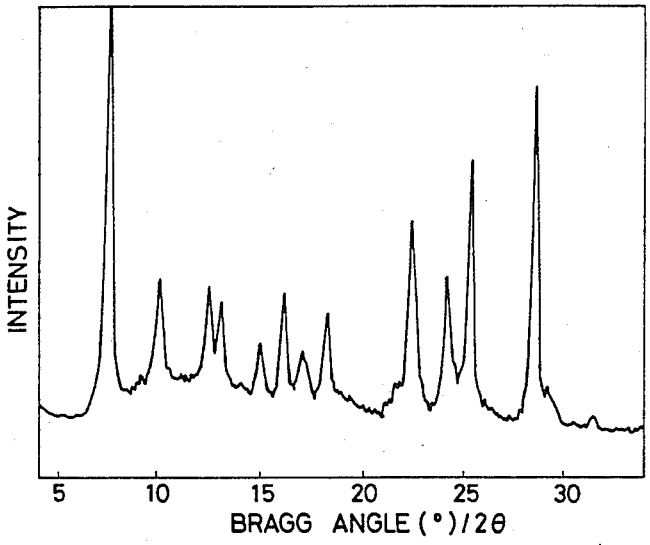
FIG. 1 is an X-ray diffraction pattern with Cu-K$\alpha$ for the alpha-type titanyl phthalocyanine used in the present invention.

An X-ray diffraction pattern for the so prepared alpha-type titanyl phthalocyanine [k=l=m=n=0 in the general formula (I)] with Cu-Kα radiation is shown in FIG. 1, from which one can see that this alpha-type titanyl phthalocyanine has characteristic peaks at Bragg angles (2θ) of 7.6, 10.2, 12.6, 13.2, 15.1, 16.2, 17.2, 18.3, 22.5, 24.2, 25.3, 28.6, 29.3 and 31.5 (inclusive of errors within the range of ±0.2 degrees).

The other alpha-type titanyl phthalocyanines which can be used in the present invention differ from the compound shown above with respect to the halogen atom as a substituent, the position of substituent, or the number of substituents, but all of them provide X-ray diffraction pattern having the same characteristic peaks as indicated in FIG. 1.

The titanyl phthalocyanine used in the present invention is preferably milled to adequately fine particles with milling machines, such as ball mills, sand mills or attritors. Milling operation may be performed in the presence of common milling media such as glass beads, steel beads or alumina beads. If necessary, milling aids such as sodium chloride or sodium bicarbonate may be employed. If dispersion media are used during the milling operation, those which are liquid at the milling temperature are preferably used. Illustrative dispersion media are such solvents as 2-ethoxyethanol, diglyme, dioxane, tetrahydrofuran, N,N-dimethylformamide, N-methylpyrrolidone, pyridine, morpholine, polyethylene glycol and the like.

Any of the resins which are commonly employed as binders in electrophotoconductors may be used as binders in the present invention, and advantageous examples include a phenol resin, urea resin, melamine resin, epoxy resin, silicone resin, vinylchloride-vinyl acetate copolymer, butyral resin, xylene resin, urethane resin, acrylic resin, polycarbonate resin, polyacrylate resin, saturated polyester resin, phenoxy resin, etc.

The electrophotoconductor of the present invention may assume various structures as shown in FIGS. 2 to 5. The photoconductor shown in FIG. 2 consists of an electrically conductive support (hereinafter referred to as a conductive support) (1) which is overlaid with a light-sensitive layer (2*a*) wherein the alpha-type titanyl phthalocyanine (3) is dispersed in a binder (4). The photoconductor shown in FIG. 3 consists of a conductive support (1) which is overlaid with a light-sensitive layer (2*b*) wherein the alpha-type titanyl phthalocyanine (3) is dispersed in a charge transport medium (5) comprised of a charge transport material and a binder. The photoconductor shown in FIG. 4 (or FIG. 5) consists of a conductive support (1) which is overlaid with a light-sensitive layer (2*c*) (or 2*d*) composed of a charge generation layer (6) having the alpha-type titanyl phthalocyanine (3) dispersed in a binder (4) and a charge transport layer (7) comprised of a charge transport material and a binder.

Figure 2:
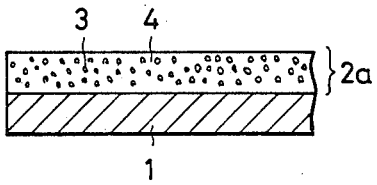
FIGS. 2 to 5 are partial enlarged cross sections of electrophotoconductors produced in accordance with the present invention.

In the photoconductor shown in FIG. 2, the alpha-type titanyl phthalocyanine (3) serves to both generate and transport charges to cause the necessary light decay. In the photoconductor shown in FIG. 3, the charge transport material combines with the binder to form the charge transport medium (5), with the alpha-type phthalcyanine (3) serving as a charge generation material. The charge transport medium (5) has the capability of accepting and transporting the charge generated from the titanyl phthalocyanine. Therefore, in the photoconductor of FIG. 3, the titanyl phthalocyanine is responsible for the production of the charge carriers necessary to cause light decay while the so produced charge are transported principally by the charge transport medium (5). In the photoconductors shown in FIGS. 4 and 5, the alpha-type titanyl phthalocyanine (3) present in the charge generation layer (6) serves to generate charges, while are injected into and transported through the charge transport layer (7).

The photoconductor of FIG. 2 may be prepared by dispersing the titanyl phthalocyanine in a solution of the binder, coating the dispersion onto a conductive support, and then drying the web. The photoconductor of FIG. 3 may be prepared by dispersing the titanyl phthalocyanine in a solution of the charge transport material and the binder, coating the dispersion onto a conductive support, and then drying the web. The photoconductor of FIG. 4 may be prepared by dispersing the titanyl phthalocyanine in a binder solution, coating the dispersion onto a conductive support, drying the coated layer, then coating a solution of the charge transport material and binder in a suitable solvent, and finally drying the web. The photoconductor of FIG. 5 may be prepared by dissolving the charge transport material and binder in a suitable solvent, coating the solution onto a conductive support, drying the coated layer, then coating a dispersion of the titanyl phthalocyanine in a binder solution, and finally drying the web. Coating operation is typically conducted by roll coating, wire bar coating, or doctor blade coating.

Figure 3:
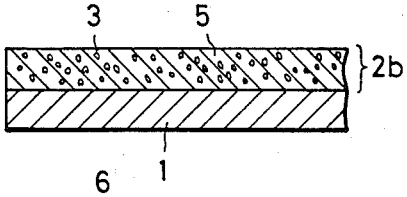
Figure 4:
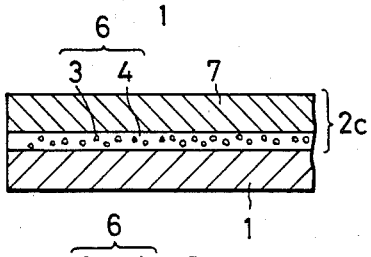
Figure 5:
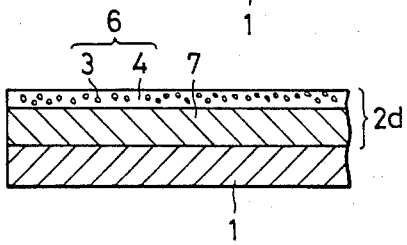

The light-sensitive layer has a thickness ranging from 3 to 50 μm, preferably from 5 to 20 μm, in the case of the photoconductors shown in FIGS. 2 and 3. If the light-sensitive layer has a dual structure as in the case of the photoconductors shown in FIGS. 4 and 5, the charge generation layer has a thickness of 5 μm or below, preferably between 0.01 and 2 μm, and the charge transport layer has a thickness ranging from 3 to 50 μm, preferably from 5 to 20 μm.

The alpha-type titanyl phthalocyanine is present in the light-sensitive layer of the electrophotoconductor of the present invention in an amount ranging from 0.05 to 90%, preferably from 5 to 50%, of the weight of the light-sensitive layer.

In order to attain an even higher sensitivity, the electrophotoconductor of the present invention may optionally contain a charge transport material and/or a charge generation material in the light-sensitive layer together with the alpha-type titanyl phthalocyanine. In this case, 100 parts by weight of the alpha-type titanyl phthalocyanine is preferably combined with 10–1,000 parts by weight of the charge transport material and/or 1 to 500 parts by weight of the charge generation material. In a more preferable case, 100 parts by weight of the alpha-type titanyl phthalocyanine is combined with 100–500 parts by weight of the charge transport mateial and 5–50 parts by weight of the charge generation material.

Examples of the charge transport material which may be used in the present invention include indoline, quinoline, triphenylamine compounds, etc. Illustrative charge generation materials are perylene and bisazo compounds. Needless to say, these charge generation materials are also capable of charge transport.

Usable indoline compounds include those which are represented by the following general formulae:

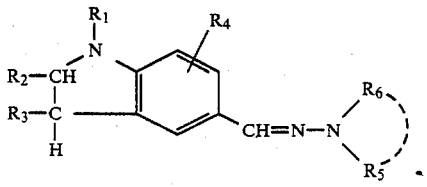

(wherein $R_1$ is an optionally substituted alkyl, aralkyl or aryl group; $R_2$ and $R_3$ each independently represents a hydrogen atom, a halogen atom, or an optionally substituted alkyl, aralkyl or aryl group; $R_4$ is a hydrogen atom, a halogen atom or an optionally substituted alkyl or aralkyl group; $R_5$ and $R_6$ each independently represents an optionally substituted alkyl, aralkyl or aryl group, provided that $R_5$ and $R_6$ may combine with each other to form a ring); and

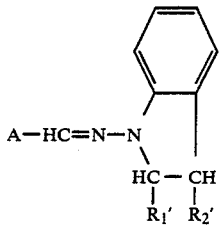

(wherein A is an optionally subsituted aromatic hydrocarbon group or aromatic heterocyclic group; and $R_1'$ and $R_2'$ each independently represents a hydrogen atom, a halogen atom, or an optionally substituted alkyl, aralkyl or aryl group).

Advantageous examples of the indoline compound are listed in Table 1 below.

TABLE 1

Indoline Compound (1)

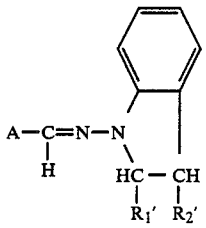

| No. | Structure of A | $-R_1'$ | $-R_2'$ |
|---|---|---|---|
| T-1 | 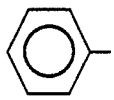 | —H | —H |
| T-2 | 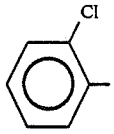  | —H | —H |
| T-3 | 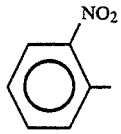  | —H | —H |
| T-4 | 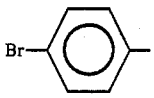  | —H | —H |
| T-5 | 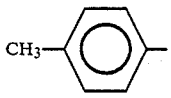  | —H | —H |

TABLE 1-continued
| | | | |
|---|---|---|---|
| T-6 | 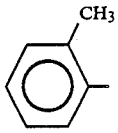 | —H | —H |
| T-7 | 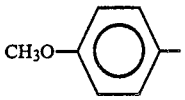 | —H | —H |
| T-8 | 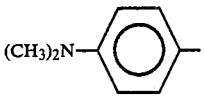 | —H | —H |
| T-9 | 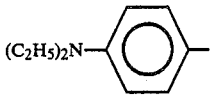 | —H | —H |
| T-10 | 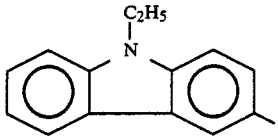 | —$CH_3$ | —H |
| T-11 | 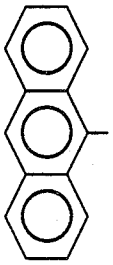 | —H | —H |
| T-12 | 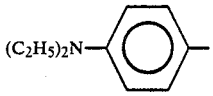 | —H | —$CH_3$ |
| T-13 | 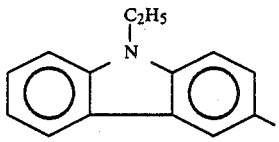 | —$CH_3$ | —$CH_3$ |
| T-14 | 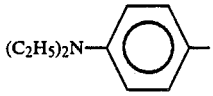 | —$CH_3$ | —H |
| T-15 | 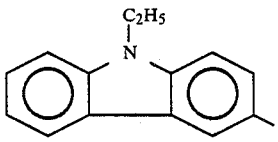 | —H | —H |
TABLE 1-continued
| | | | |
|---|---|---|---|
| T-16 | 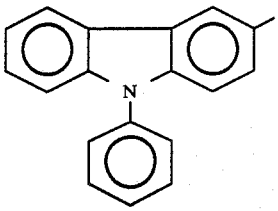 | —$CH_3$ | —H |
| T-17 | 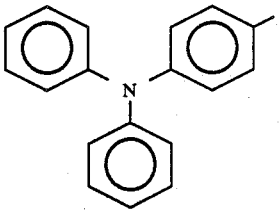 | —$CH_3$ | —H |
| T-18 | 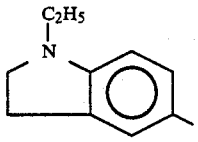 | —$CH_3$ | —H |
| T-19 | 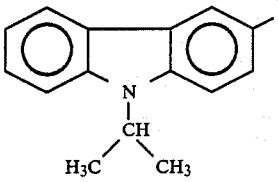 | —$CH_3$ | —H |
Indoline Compound (2)
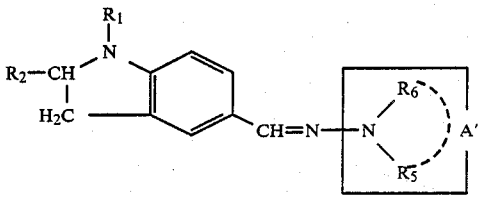
| No. | Structure of A' | —$R_1$ | —$R_2$ |
|---|---|---|---|
| T-20 | 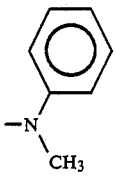 | —$CH_3$ | —H |
| T-21 | 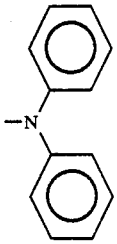 | —$CH_3$ | —H |

TABLE 1-continued

| | | | |
|---|---|---|---|
| T-22 | 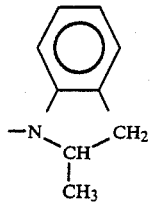 | $-C_2H_5$ | $-H$ |
| T-23 | 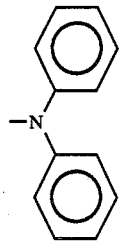 | $-C_2H_5$ | $-H$ |
| T-24 | 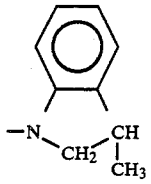 | $-C_2H_5$ | $-H$ |
| T-25 | 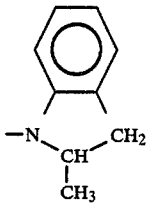 | $-C_2H_5$ | $-H$ |
| T-26 | 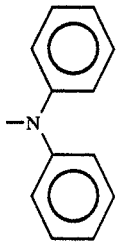 | $-CH_3$ | $-CH_3$ |
| T-27 | 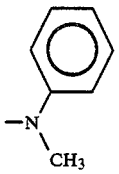 | $-CH_3$ | $-CH_3$ |
| T-28 | 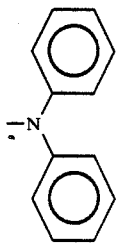 | $-CH_3$ | 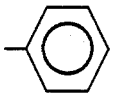 |

Illustrative quinoline compounds are those which are represented by the following general formula:

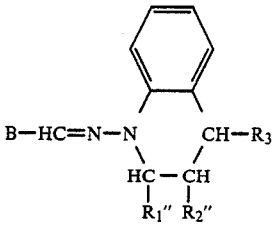

(wherein B is an optionally substituted aromatic hydrocarbon group or aromatic heterocyclic group; $R_1''$, $R_2''$ and $R_3$ each independently represents a hydrogen atom, a halogen atom or an optionally substituted alkyl, aralkyl or aryl group). Advantageous examples of the quinoline compounds are listed in Table 2 below.

TABLE 2

Quinoline Compound (1)

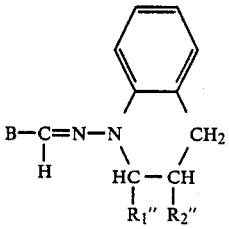

| No. | Structure of B | $-R_1''$ | $-R_2''$ |
|---|---|---|---|
| T-29 | 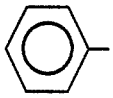 | $-H$ | $-H$ |
| T-30 | 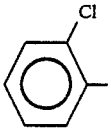 | $-H$ | $-H$ |
| T-31 | 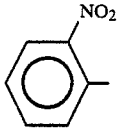 | $-H$ | $-H$ |
| T-32 | 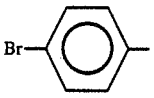 | $-H$ | $-H$ |
| T-33 | 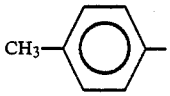 | $-H$ | $-H$ |
| T-34 | 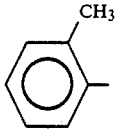 | $-H$ | $-H$ |

TABLE 2-continued

Quinoline Compound (1)

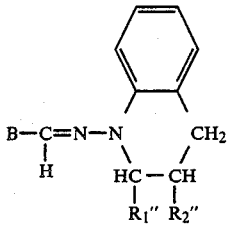

| No. | Structure of B | $-R_1''$ | $-R_2''$ |
|---|---|---|---|
| T-35 | 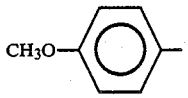 | —H | —H |
| T-36 | 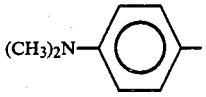 | —H | —H |
| T-37 | 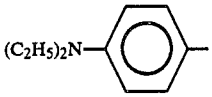 | —H | —H |
| T-38 | 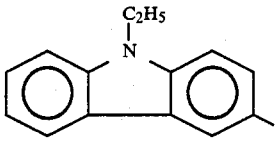 | $-CH_3$ | —H |
| T-39 | 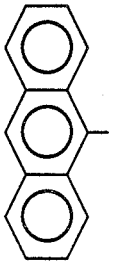 | —H | —H |
| T-40 | 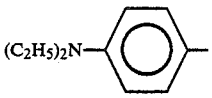 | —H | $-CH_3$ |
| T-41 | 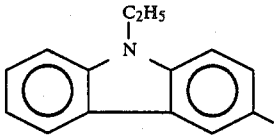 | $-CH_3$ | $-CH_3$ |
| T-42 | 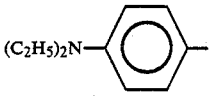 | $-CH_3$ | —H |
| T-43 | 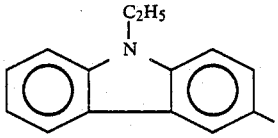 | —H | —H |

TABLE 2-continued

Quinoline Compound (1)

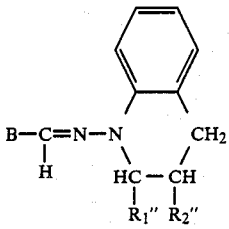

| No. | Structure of B | $-R_1''$ | $-R_2''$ |
|---|---|---|---|
| T-44 | 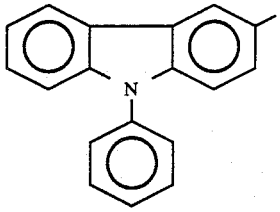 | $-CH_3$ | —H |
| T-45 | 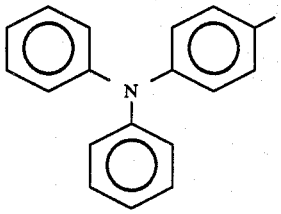 | $-CH_3$ | —H |

Illustrative triphenylamine compounds are those which are represented by the following general formula:

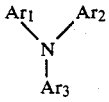

(wherein $Ar_1$, $Ar_2$ and $Ar_3$ each independently represents a substituted or unsubstituted aromatic hydrocarbon group or a substituted or unsubstituted aromatic heterocyclic group). Advantageous examples of the triphenylamine compound are listed in Table 3 below.

TABLE 3

Triphenylamine Compound

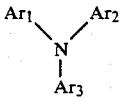

| No. | $-Ar_1$ | $-Ar_2$ | $-Ar_3$ |
|---|---|---|---|
| T-46 | 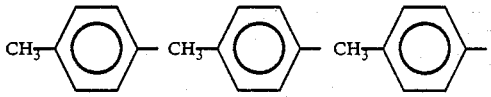 | | |
| T-47 | 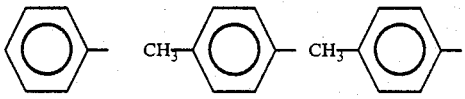 | | |

Other well known charge transport materials may also be employed and they include derivatives of such heterocyclic compounds as pyrazole, pyazoline, oxadiazole, thiazole, imidazole, etc.; hydrazone derivatives; triphenylmethane derivatives; and poly-N-vinylcarbazole and derivatives thereof.

Any of the bisazo compounds commonly used in electrophotographic photoconductors may be used in the present invention, and they include:

(1) Compounds of the general formula:

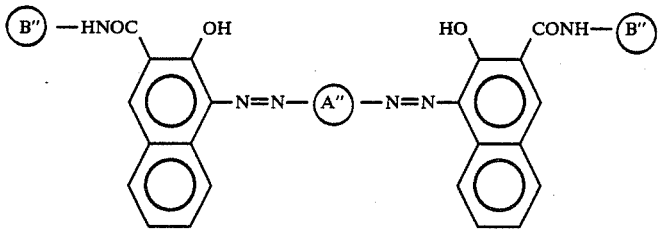

(wherein — A'' — is a divalent conjugate organic group; and — B'' is a monovalent organic group);

(2) Compounds of the general formula:

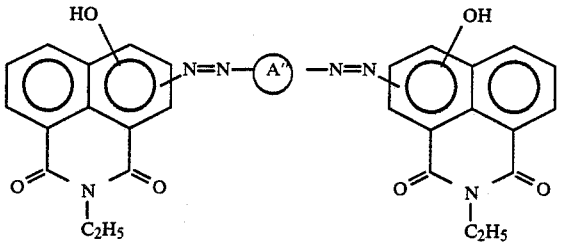

(wherein — A'' — is a divalent conjugate organic group); and (3) Compounds of the general formula:

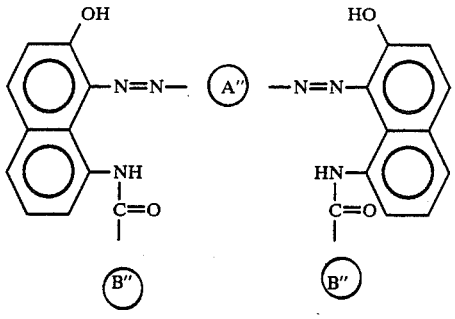

(wherein — A'' — is a divalent conjugate organic group; and — B'' is a monovalent organic group).

Advantageous examples of the biazo compound which is suitable for use in the present invention are listed in Table 4 below.

TABLE 4

Bisazo Compound (1)

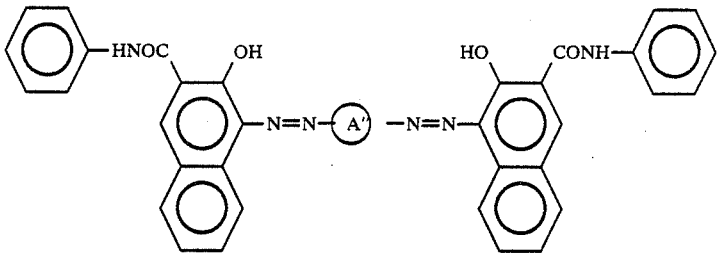

| No. | Structure of —A''— |
|---|---|
| P-1 | 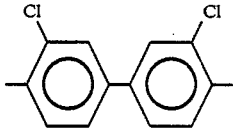 |
| P-2 | 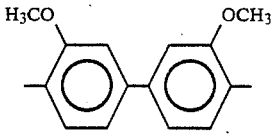 |

TABLE 4-continued
P-3
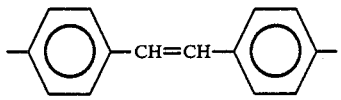
P-4
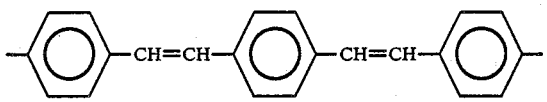
P-5
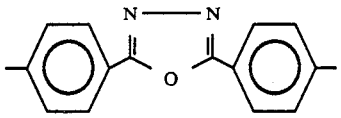
P-6
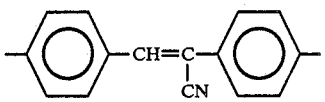
P-7
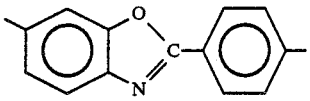
P-8
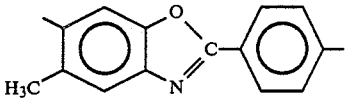
P-9
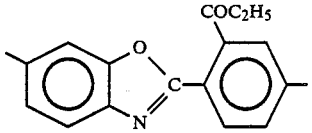
P-10
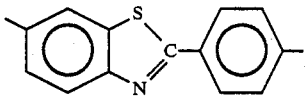
P-11
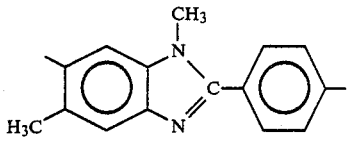
P-13
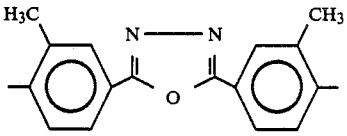
P-14
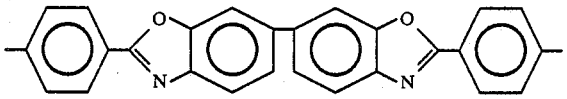
P-15
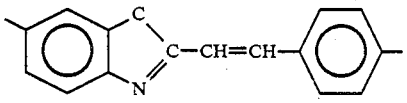
P-16
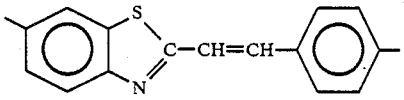

TABLE 4-continued
P-17
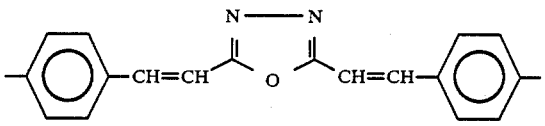
P-18
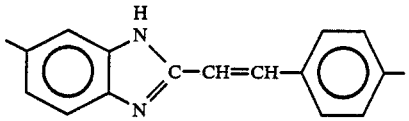
P-19
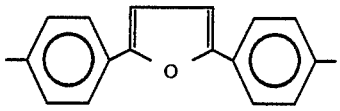
P-20
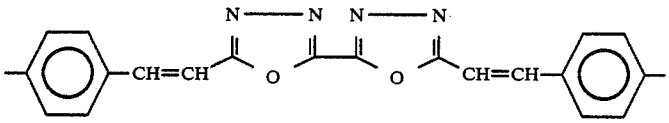
P-21
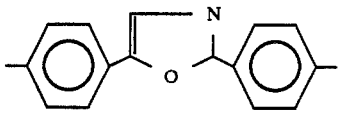
P-22
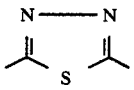
P-23
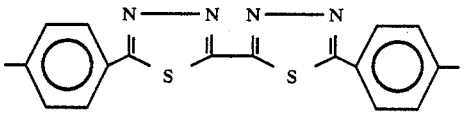
Bisazo Compound (2)
P-12
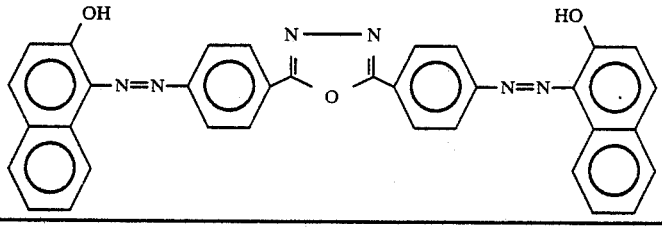
Bisazo Compound (3)
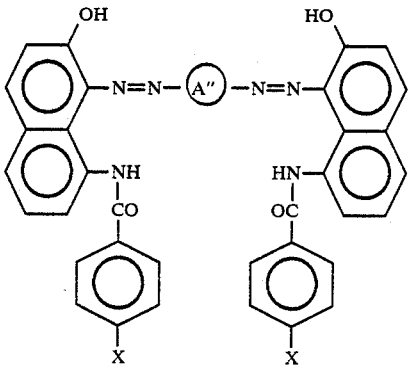
| No. | Structure of —(A")— | —X |
|---|---|---|

TABLE 4-continued
| | | |
|---|---|---|
| P-24 | 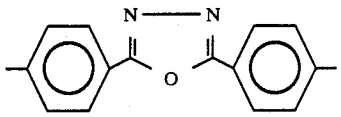 | —H |
| P-25 | 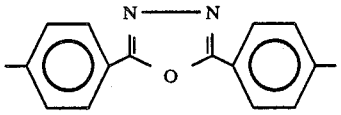 | —Cl |
| P-26 | 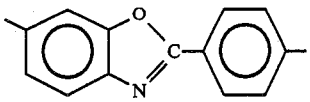 | —Cl |
| P-27 | 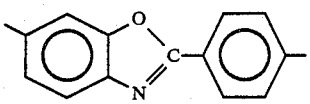 | —H |
| P-28 | 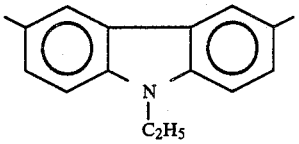 | —H |
| P-29 | 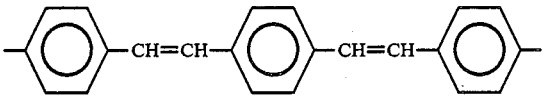 | —H |
| P-30 | 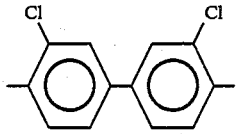 | —H |
| P-31 | 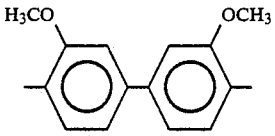 | —H |
| P-32 | 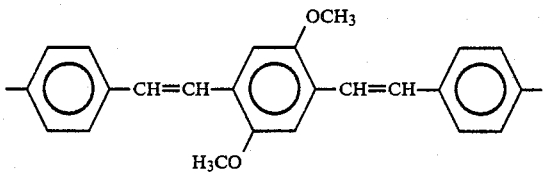 | —H |
| P-33 | 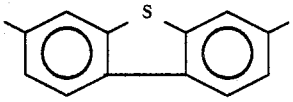 | —H |
| P-34 | 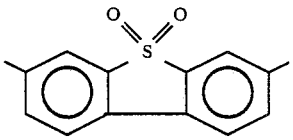 | —H |

TABLE 4-continued
| | | |
|---|---|---|
| P-35 | 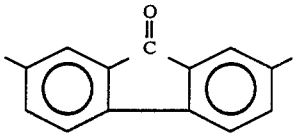 | —H |
| P-36 | 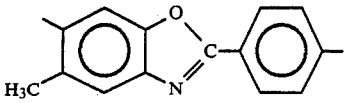 | —H |
Bisazo Compound (4)
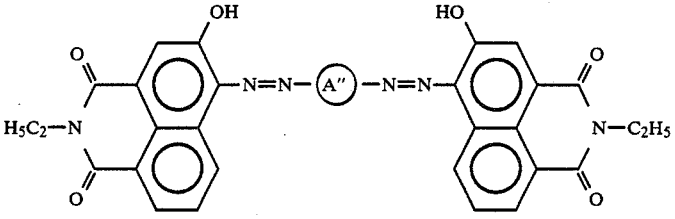
| No. | Structure of —(A″)—* |
|---|---|
| P-37 | 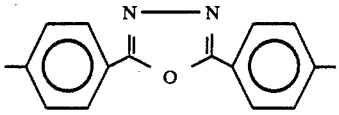 |
| P-38 | 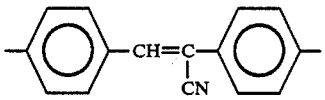 |
| P-39 | 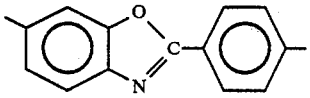 |
| P-40 | 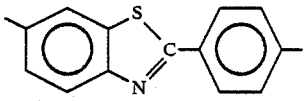 |
Bisazo Compound (5)
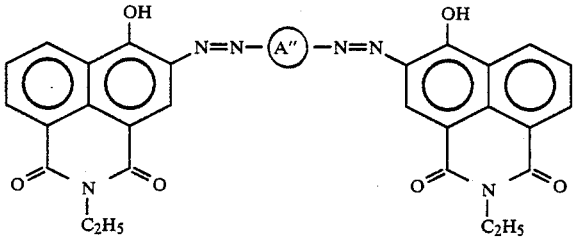
| No. | Structure of —(A″)— |
|---|---|
| P-41 | 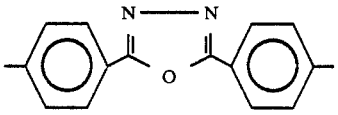 |
| P-42 | 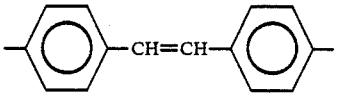 |

TABLE 4-continued
P-43
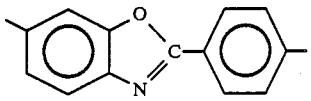
P-44
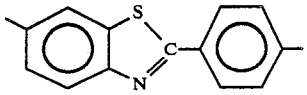
Bisazo Compound (6)
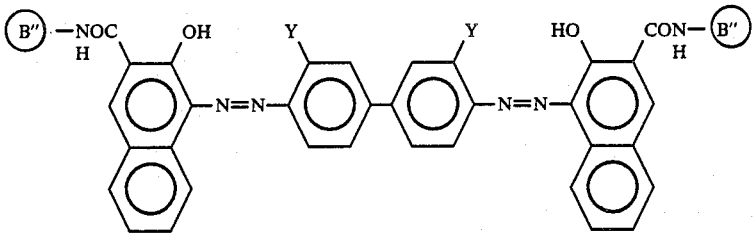
| No. | Structure of (B″) — | —Y |
|---|---|---|
| P-45 | 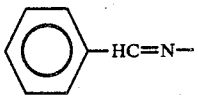 | —Cl |
| P-46 | 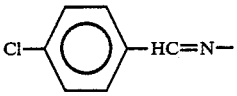 | —Cl |
| P-47 | 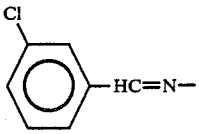 | —Cl |
| P-48 | 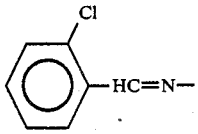 | —Cl |
| P-49 | 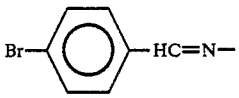 | —Cl |
| P-50 | 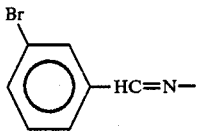 | —Cl |
| P-51 | 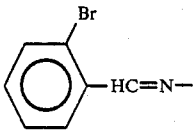 | —Cl |
| P-52 | 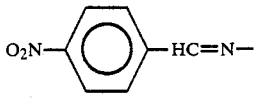 | —Cl |

TABLE 4-continued
| | | |
|---|---|---|
| P-53 | 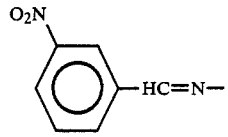 | —Cl |
| P-54 | 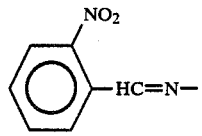 | —Cl |
| P-55 | 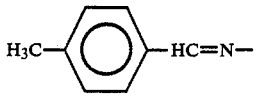 | —Cl |
| P-56 | 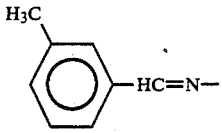 | —Cl |
| P-57 | 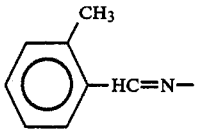 | —Cl |
| P-58 | 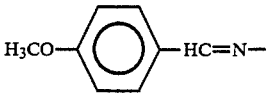 | —Cl |
| P-59 | 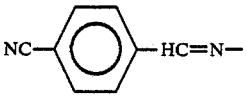 | —Cl |
| P-60 | 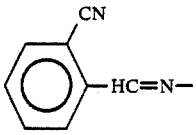 | —Cl |
| P-61 | 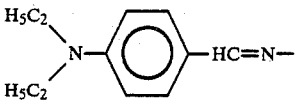 | —Cl |
| P-62 | 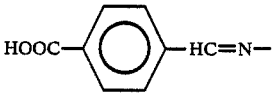 | —Cl |
| P-63 | 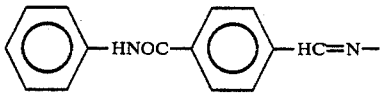 | —Cl |
| P-64 | 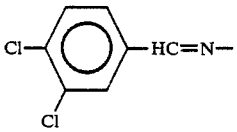 | —Cl |

TABLE 4-continued
| | | |
|---|---|---|
| P-65 | 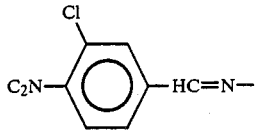 | —Cl |
| P-66 | 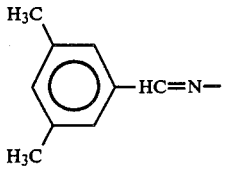 | —Cl |
| P-67 | 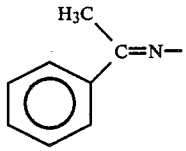 | —Cl |
| P-68 | 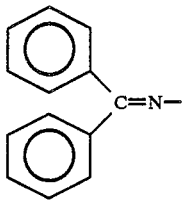 | —Cl |
| P-69 | 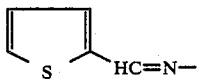 | —Cl |
| P-70 | 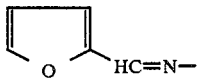 | —Cl |
| P-71 | 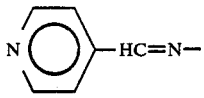 | —Cl |
| P-72 | 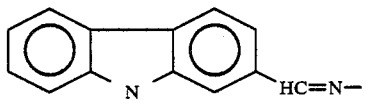 | —Cl |
| P-73 | 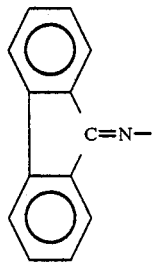 | —Cl |

TABLE 4-continued
| | | |
|---|---|---|
| P-74 | 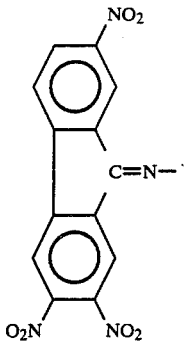 | —Cl |
| P-75 | 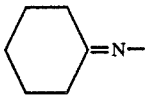 | —Cl |
| P-76 | 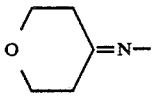 | —Cl |
| P-77 | 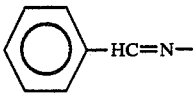 | —$CH_3$ |
| P-78 | 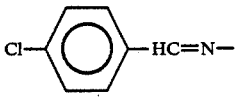 | —$CH_3$ |
| P-79 | 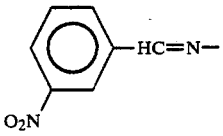 | —$CH_3$ |
| P-80 | 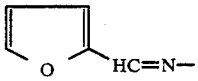 | —$CH_3$ |
| P-81 | 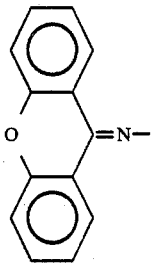 | —$CH_3$ |
| P-82 | 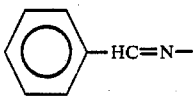 | —$OCH_3$ |
| P-83 | 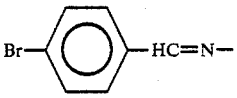 | —$OCH_3$ |

TABLE 4-continued
| | | |
|---|---|---|
| P-84 | 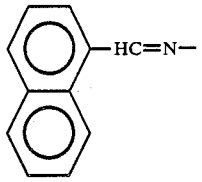 | $-OCH_3$ |
| P-85 | 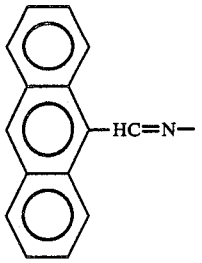 | $-OCH_3$ |
| P-86 | 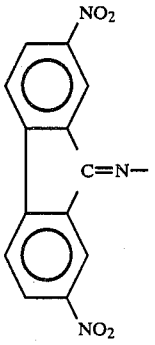 | $-OCH_3$ |
| P-87 | 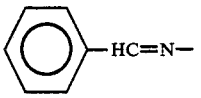 | $-NO_2$ |
| P-88 | 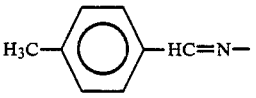 | $-NO_2$ |
| P-89 | 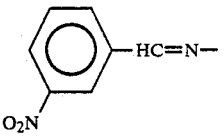 | $-NO_2$ |
| P-90 | 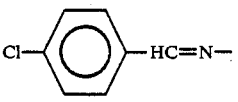 | $-NO_2$ |
| P-91 | 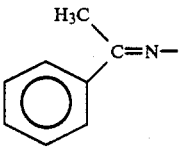 | $-NO_2$ |
| P-92 | 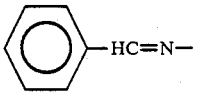 | $-H$ |

TABLE 4-continued

| | | |
|---|---|---|
| P-93 | 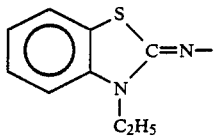 | —H |
| P-94 | 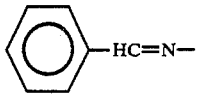 | —Br |

A perylene compound may be used as a charge generation material together with the titanyl phthalocyanine in the present invention and examples of usable perylene compounds are represented by the following general formula:

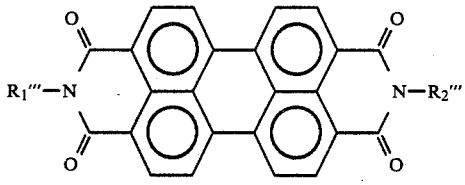

(wherein $R_1'''$ and $R_2'''$ each independently represents a hydrogen atom or a substituted or unsubstituted alkyl, aryl, alkylaryl or amino group).

Advantageous examples of the perylene compounds are listed in Table 5 below.

TABLE 5

Perylene Compound (1)

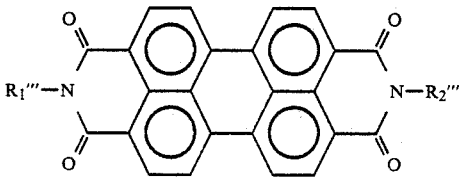

| No. | $-R_1'''$ and $-R_2'''$ |
|---|---|
| P-95 | $-NH_2$ |
| P-96 | —H |
| P-97 | $-CH_3$ |
| P-98 | $-CH_2CH_3$ |
| P-99 | $-(CH_2)_2CH_3$ |
| P-100 | $-(CH_2)_3CH_3$ |
| P-101 | $-CH_2CH_2OH$ |
| P-102 | $-(CH_2)_3-OCH_3$ |
| P-103 | 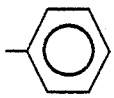 |
| P-104 | 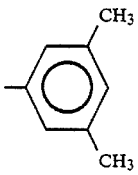 |

TABLE 5-continued

| | |
|---|---|
| P-105 | 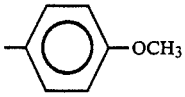 |
| P-106 | 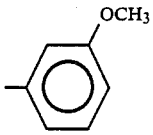 |
| P-107 | 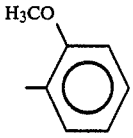 |
| P-108 | 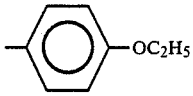 |
| P-109 | 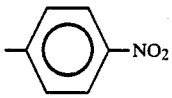 |
| P-110 | 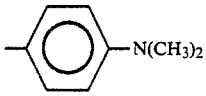 |
| P-111 | 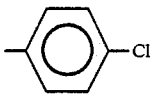 |
| P-112 | 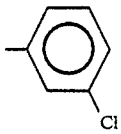 |
| P-113 | 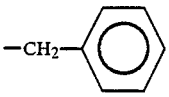 |
| P-114 | 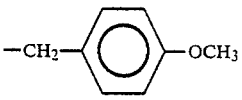 |

TABLE 5-continued

| | |
|---|---|
| P-115 | 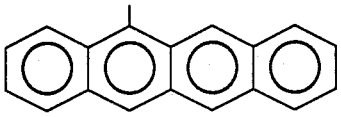 |
| P-116 | 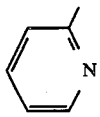 |
| P-117 | 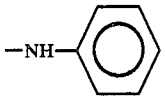 |
| Perylene Compound (2) | |
| P-118 | 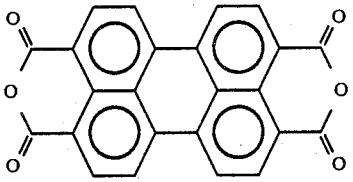 |

The conductive support for the photoconductor of the present invention may be a metal (e.g. aluminum) plate or foil, a plastic film on which the vapor of a metal (e.g. aluminum) is deposited, or paper which has been rendered conductive.

If necessary, the electrophotoconductor of the present invention may have an adhesive layer or a barrier layer provided between the conductive support and the light-sensitive layer. An adhesive or barrier layer may be formed of a polyamide, nitrocellulose, casein or poly(vinyl alcohol), and its thickness is desirable not greater than 1 μm.

The following examples are provided for the purpose of further illustrating the present invention. It should however be understood that various modifications may be made to the following examples without departing from the spirit and scope of the invention.

The compound numbers of the charge transport materials (i.e., indoline, quinoline and triphenylamine compounds) used in the following examples are indicated in Tables 1 to 3, while the compound numbers of the charge generation materials used in the same examples are noted in Tables 4 and 5 (i.e., bisazo and perylene compounds).

In the examples, all parts are on a weight basis unless otherwise specified.

EXAMPLE 1

(I) Preparation of Alpha-Type Titanyl Phthalocyanine

Titanium tetrachloride (18 g) and phthalodinitrile (40 g) were agitated in α-chloronaphthalene (500 ml) at 240°-250° C. under a nitrogen stream. After completion of the reaction, the product dichlorotitanium phthalocyanine was recovered by filtration. The recovered dichlorotitanium phthalocyanine was heated under reflux for 1 hour together with concentrated aqueous ammonia (300 ml) and pyridine (300 ml) so as to obtain the end compound, α-type titanyl phthalocyanine (18 g). This compound was thoroughly washed in a Soxhlet extractor first with N,N-dimethylformamide, then with acetone.

An X-ray diffraction pattern for the α-type titanyl phthalocyanine thus obtained with Cu-Kα radiation is shown in FIG. 1.

(II) Preparation of Electrophotoconductor

The α-type titanyl phthalocyanine prepared in (I) was milled in a ball mill for 64 hours with alumina beads being used as a milling medium. On part of the fine particles of α-type titanyl phthalocyanine, 6 parts of a saturated polyester resin (Vylon 200 by Toyobo Co., Ltd.) and 36 parts of a 4:6 liquid mixture of 1,1,2-trichloroethane/dichloromethane were mixed in a paint shaker for 2 hours with glass beads being used as a mixing medium. The resulting dispersion was applied to an aluminum plate with a wire bar coater to form a light-sensitive layer having a dry thickness of 10 μm.

The so prepared single-layer electrophotoconductor was subjected to a sensitivity test with a Paper Analyzer SP-428 of Kawaguchi Electric Works Co., Ltd. by the following procedures: the photoconductor was charged to a positive voltage of 6 kV by corona discharge in the dark and the initial potential ($V_0$) was measured; the charged photoconductor was then left in the dark for 10 seconds and the surface potential retention ($V_{10}/V_0$ [%]) was measured; the photoreceptor was then exposed under a tungsten lamp for a surface illumination of 5 lux, and the photosensitivity $E\ \frac{1}{2}$ (or E 1/5), or the exposure required for the surface potential to drop to half (or one-fifth) of the initial value, was measured; in a similar manner, the surface potential retained after 15 seconds of exposure was measured; $E\ \frac{1}{2}$ and E 1/5 values were also measured by illuminating the photoreceptor with monochromatic light at 830 nm (intensity, 10 $mW/m^2$).

Figure 6:
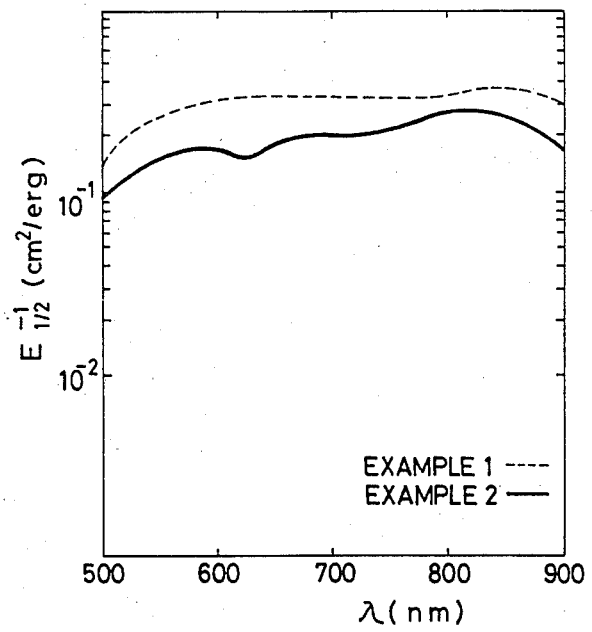
FIG. 6 is a graph showing the spectral sensitivities of the electrophotoconductors prepared in Examples 1 and 2.

The spectral sensitivity of the photoreceptor is shown in FIG. 6, from which one can see that over the broad range of 520 to 900 nm it exhibited sensitivities higher than $E\ \frac{1}{2}^{-1}=0.1\ cm^2/erg$ ($E\ \frac{1}{2}=10\ erg/cm^2$) which is the value required for commercially acceptable photoconductors to be used with a laser printer.

Figure 7:
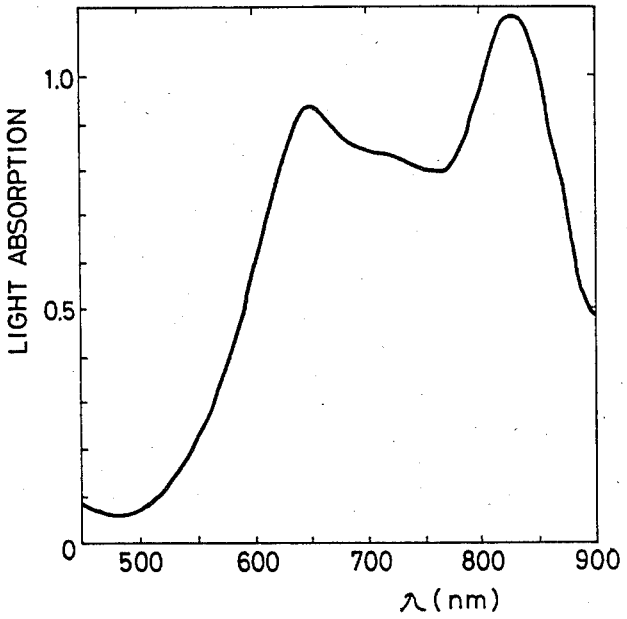
FIG. 7 is a diagram showing the visible light absorption spectrum of the light-sensitive layer in the photoconductor prepared in Example 1.
Figure 8:
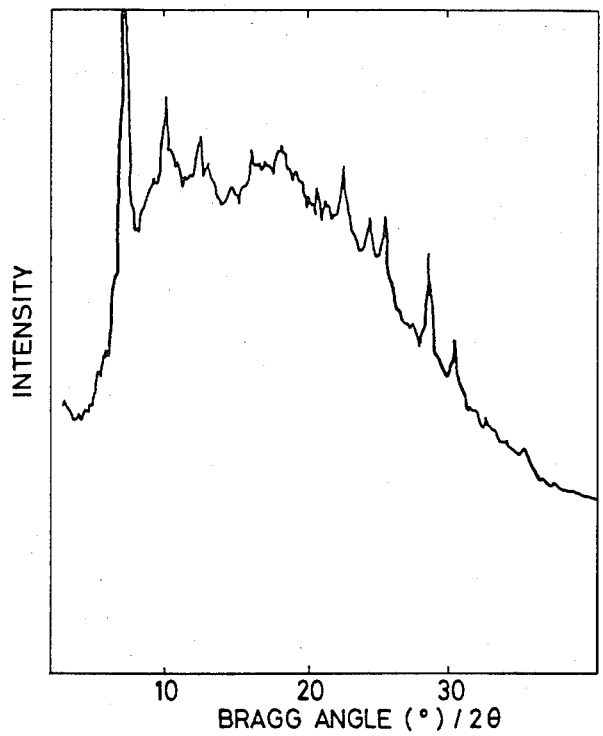
FIG. 8 is an X-ray diffraction pattern for the light-sensitive coating formed in Example 1.

A coating solution of light-sensitive material was prepared as in Example 1 and applied to a transparent PET film. The visible light absorption spectrum of the obtained light-sensitive layer is shown in FIG. 7, with absorption maxima occurring at 650 nm and 830 nm. An X-ray diffraction pattern for the same layer is shown in FIG. 8.

EXAMPLE 2

Three parts of the fine particles of α-type titanyl phthalocyanine which were obtained as in Example 1, 1 part of a saturated polyester resin (Vylon 200) and 210 parts of chloroform were mixed in a ball mill for 18 hours with alumina beads being used as a mixing medium. The resulting dispersion was coated with a wire bar onto a polyester film having a vapor-deposited aluminum layer, so as to form a charge generation layer having a dry thickness of 0.3 μm.

A solution wherein 5 parts of a charge transport material (No. T-10) and 5 parts of a polycarbonate resin (Panlite-1250 by Teijin Chemicals Ltd.) was dissolved in 65 parts of chloroform was coated onto the charge generation layer with a wire bar, so as to form a charge transport layer having a dry thickness of 10 μm.

The characteristics of the so prepared multilayer electrophotoconductor were evaluated as in Example 1 except that $V_0$ was measured with the photoconductor being charged to a negative voltage of 6 kV by corona discharge.

EXAMPLE 3

A solution of 8 parts of a charge transport material (No. T-10) and 8 parts of a polyarylate resin (U-100 by Union Carbide Corporation) in 92 parts of dioxane was applied to form a layer having a dry thickness of 10 μm. Three parts of the fine particles of α-type titanyl phthalocyanine which were prepared as in Example 1, 1 part of a charge generation layer (No. P-53), 6 parts of a charge transport material (No. T-10), 15 parts of a polyarylate resin (U-100) and 150 parts of chloroform were mixed in a paint shaker and the resulting dispersion was applied to the charge transport layer, so as to form a charge generation layer having a dry thickness of 5 μm. By these procedures, a multi-layer electrophoto-conductor was obtained.

COMPARATIVE EXAMPLE 1

Figure 9:
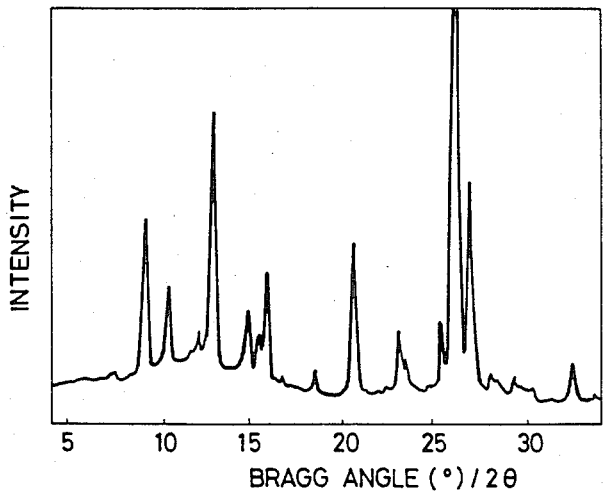
FIG. 9 is an X-ray diffraction pattern for a beta-type titanyl phthalcocyanine.

Alpha-type titanyl phthalocyanine was prepared as in Example 1(I) and recrystallized from α-chloronaphthalene. By further purification, beta-type titanyl phthalocyanine was obtained which had characteristic peaks at Bragg angles (2θ) of 7.4, 9.2, 10.3, 13.0, 14.9, 15.3, 15.9, 18.6, 20.6, 23.2, 25.5, 26.2, 27.0 and 32.7. An X-ray diffraction pattern for this beta-type titanyl phthaocyanine is shown in FIG. 9. A single-layer electrophotoconductor was prepared as in Example 1 except that the α-type titanyl phthalocyanine was replaced by the above-prepared β-type titanyl phthalocyanine. The characteristics of the photoconductor were evaluated as in Example 1.

COMPARATIVE EXAMPLE 2

A multi-layer electrophotoconductor was prepared as in Exmaple 2 except that the α-type titanyl phthalocyanine was replaced by the β-type titanyl phthalocyanine prepared in Comparative Example 1. The characteristics of the photoconductor were evaluated as in Example 1.

The characteristics of the photoconductors prepared in Examples 1 to 3 and Comparative Examples 1 and 2 are summarized in Table 6 below.

TABLE 6

| Run No. | $V_0$ (V) | $V_{10}/V_0$ (%) | Illumination by tungsten lamp: E 1/2 (lux · sec) | E 1/5 (lux · sec) | $V_{15}$ (V) | Exposure to light at 830 nm: E 1/2 (erg/cm²) | E 1/5 (erg/cm²) |
|---|---|---|---|---|---|---|---|
| Example 1 | (+)600 | 86.0 | 0.7 | 0.9 | 8 | 3.6 | 3.9 |
| Example 2 | (−)580 | 76.0 | 0.8 | 1.8 | 5 | 2.7 | 5.1 |
| Example 3 | (+)500 | 65.0 | 1.4 | 3.3 | 15 | 6.5 | — |
| Comparative Example 1 | (+)160 | 54.0 | 4.4 | not available | 30 | — | — |
| Comparative Example 2 | (−)390 | 60.3 | 2.0 | 5.6 | 8 | 8.0 | 22.4 |

EXAMPLES 4 TO 7

Three parts of the fine particles of titanyl phthalocyanine which were prepared as in Example 1, 1 part of a saturated polyester resin (Vylon 200) and 210 parts of one of the solvents shown in Table 7 were mixed in a ball mill for 18 hours with alumina beads being used as a mixing medium. The resulting dispersion was coated with a wire bar onto a polyester film having a vapor-deposited aluminum layer, so as to form a charge generation layer having a dry thickness of 0.3 μm. Subsequently, a multilayer electrophotoconductor was prepared as in Example 2. Additional photoconductors were obtained by the same procedures. Each of the photoconductors was illuminated by light at 830 nm (intensity, 10 mW/m²) and its sensitivity (E 1/5) was measured. The results are shown in Table 7.

TABLE 7

| Example No. | Solvent | E 1/5 (erg/cm²) |
|---|---|---|
| 4 | toluene | 5.1 |
| 5 | dioxane | 5.1 |
| 6 | tetrahydrofuran | 4.0 |
| 7 | methylene chloride/ 1,2,2-trichloroethane (6/4) | 5.1 |

EXAMPLES 8 TO 15

Additional photoconductors were fabricated as in Example 2 except that the charge transport material (No.T-10) was replaced by one of the materials shown in Table 8. Each of the photoconductors thus fabricated was irradiated by light at 830 nm (intensity, 10 mW/m²) and its sensitivity (E 1/5) was measured. The results are shown in Table 8.

TABLE 8

| Example No. | Charge transport material No. | E 1/5 (erg/cm²) |
|---|---|---|
| 8 | T-9 | 20.0 |
| 9 | T-16 | 5.1 |
| 10 | T-17 | 4.0 |
| 11 | T-19 | 4.4 |
| 12 | T-24 | 20 |
| 13 | T-38 | 4.4 |
| 14 | T-41 | 4.6 |
| 15 | T-47 | 8.0 |

EXAMPLE 16 TO 21

Three parts of the fine particles of α-type titanyl phthalocyanine which were prepared as in Example 1, 1 part of a saturated polyester resin (Vylon 200), 210 parts of chloroform, and 0.9 parts of one of the charge generation materials listed in Table 9 were mixed in a ball mill for 18 hours with alumina beads being used as a mixing medium. The resulting dispersion was coated with a wire bar onto a polyester film having a vapor-deposited aluminum layer, so as to form a charge generation layer having a dry thickness of 0.3 μm. Subsequently, multilayer electrophotoconductors were prepared as in Example 2. The so-prepared photoconductors had the characteristics summarized in Table 9.

TABLE 9

| Example No. | Charge generation material No. | $V_0$ (V) | $V_{10}/V_0$ (%) | Illumination by light at 830 nm E 1/5 (erg/cm$^2$) |
|---|---|---|---|---|
| 16 | P-4 | 640 | 82 | 5.2 |
| 17 | P-17 | 650 | 82 | 5.2 |
| 18 | P-37 | 665 | 84 | 5.4 |
| 19 | P-47 | 620 | 80 | 5.2 |
| 20 | P-53 | 650 | 82 | 5.4 |
| 21 | P-104 | 610 | 78 | 5.2 |

The electrophotoconductor of the present invention has a light-sensitive layer wherein the alpha-type titanyl phthalocyanine specified herein-above is dispersed in a binder, and it has high sensitivity over a broad wavelength region of 500 to 900 nm. The photoconductor of the present invention will provide particularly good results when it is used with a laser beam printer or an LED printer employing a light source having wavelengths within the range of 700–900 nm.

The application of the electrophotoconductor of the present invention is not limited to printing with laser beam printers; it can also be applied to various other optical recording devices employing light sources such as semiconductor laser operating at wavelengths longer than 780 nm.

While the invention has been described in detail and with reference to specific embodiments thereof, it will be apparent to one skilled in the art that various changes and modifications can be made therein without departing from the spirit and scope thereof.

What is claimed is:

1. An electrophotoconductor for use in electrophotography, which comprises an electrically conductive support and a light-sensitive layer comprising a titanyl phthalocyanine dispersed in a binder and having the structure represented by the formula:

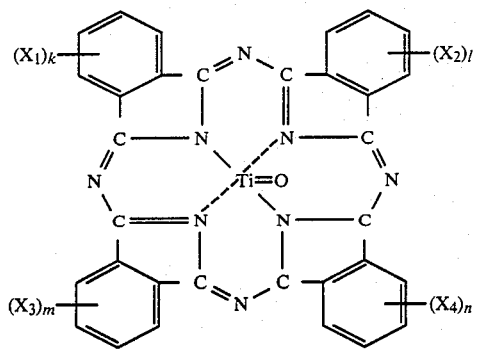

wherein $X_1$, $X_2$, $X_3$ and $X_4$ each and independently represent c or Br; and k, l, m and n each and independently represent zero or an integer of 1 to 4 and having the alpha-type crystallographic form.

2. An electrophotoconductor according to claim 1, wherein said alpha-type titanyl phthalocyanine, upon X-ray diffraction with Cu-Kα radiation, provides characteristic peaks at Bragg angles (2θ) of 7.6, 10.2, 12.6, 13.2, 15.1, 16.2, 17.2, 18.3, 22.5, 24.2, 25.3, 28.6, 29.3 and 31.5.

3. An electrophotoconductor according to claim 1, wherein said light-sensitive layer is a single layer.

4. An electrophotoconductor according to claim 3, wherein said light-sensitive layer contains a charge transport material.

5. An electrophotoconductor according to claim 3, wherein said light-sensitive layer contains a charge generation material.

6. An electrophotoconductor according to claim 3, wherein said light-sensitive layer contains both a charge transport material and a charge generation material.

7. An electrophotoconductor according to claim 4, wherein said charge transport material is at least one compound selected from the group consisting of indoline compounds, quinoline compounds and triphenylamine compounds.

8. An electrophotoconductor according to claim 5, wherein said charge generation material is selected from the group consisting of perylene compounds and bisazo compounds.

9. An electrophotoconductor according to claim 7, wherein said indoline compound is represented by the formula:

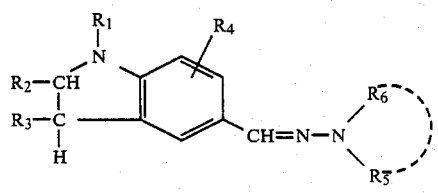

wherein $R_1$ is selected from the group consisting of alkyl, aralkyl, substituted araklyl, aryl and substituted aryl; $R_2$ and $R_3$ are each independently selected from the group consisting of hydrogen, halogen, alkyl, aralkyl, substituted aralkyl, aryl and substituted aryl; $R_4$ is selected from the group consisting of hydrogen, halogen, alkyl, aralkyl and substituted aralkyl; $R_5$ and $R_6$ are each independently selected from the group consisting of alkyl, aralkyl, substituted aralkyl, aryl and substituted aryl and $R_5$ and $R_6$ may be bonded to each other to form a ring.

10. An electrophotoconductor according to claim 7, wherein said indoline compound is represented by the formula:

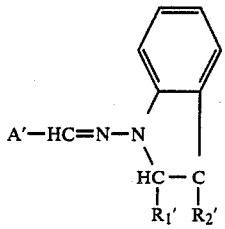

wherein A is selected from the group consisting of aromatic hydrocarbon, substituted aromatic hydrocarbon, aromatic heterocyclic and substituted aromatic heterocyclic; and $R_1'$ and $R_2'$ are each independently selected from the group consisting of hydrogen, halogen, alkyl, aralkyl, substituted aralkyl aryl and substituted aryl.

11. An electrophotoconductor according to claim 7, wherein said quinoline compound is represented by the formula:

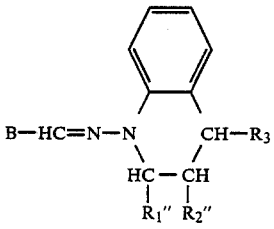

wherein B is selected from the group consisting of aromatic hydrocarbon, substituted aromatic hydrocarbon, aromatic heterocyclic and substituted aromatic heterocyclic; $R_1''$, $R_2''$ and $R_3$ are each independently selected from the group consisting of hydrogen, halogen, alkyl, aralkyl, substituted aralkyl, aryl and substituted aryl.

12. An electrophotoconductor according to claim 7, wherein said triphenylamine compound is represented by the formula:

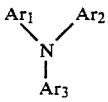

wherein $Ar_1$, $Ar_2$ and $Ar_3$ are each independently selected from the group consisting of aromatic hydrocarbon, selected aromatic hydrocarbon aromatic heterocyclic and substituted aromatic heterocyclic.

13. An electrophotoconductor according to claim 8, wherein said perylene compound is represented by the formula:

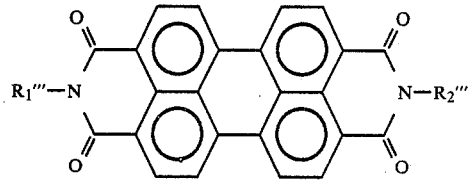

wherein $R_1'''$ and $R_2'''$ are each independently selected from the group consisting of hydrogen alkyl, aryl, substituted aryl and amino.

14. An electrophotoconductor according to claim 8, wherein said perylene compound is represented by the formula:

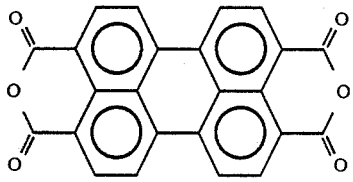

15. An electrophotoconductor according to claim 8, wherein said bisazo compound is represented by the formula:

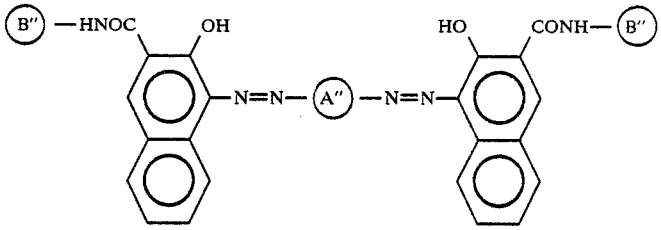

(wherein — A'' — is a divalent conjugate organic group; and — B'' is a monovalent organic group).

16. An electrophotoconductor according to claim 8, wherein said bisazo compound is represented by the formula:

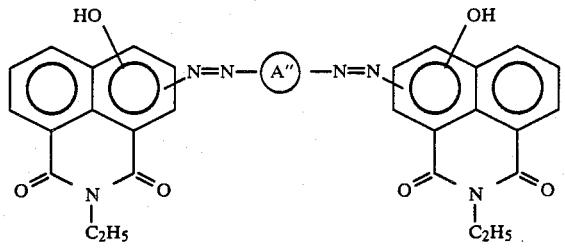

(wherein —(A")— is a divalent conjugate organic group).

17. An electrophotoconductor according to claim 8, wherein said bisazo compound is represented by the formula:

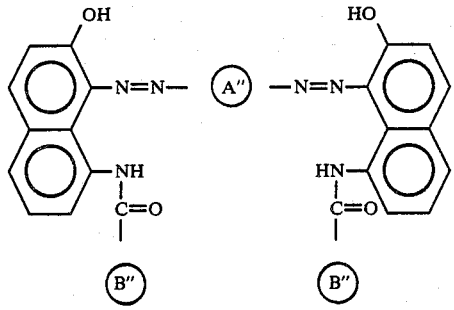

(wherein —(A")— is a divalent conjugate organic group; and —(B")— is a monovalent organic group).

18. An electrophotoconductor according to claim 1, wherein said light-sensitive layer is a multi-layer which comprises a charge generation layer and a charge transport layer.

19. An electrophotoconductor according to claim 18, wherein said charge transport layer contains a charge transport material.

20. An electrophotoconductor according to claidm 18, wherein said charge generation layer contains a charge generation material.

21. An electrophotoconductor according to claim 19, wherein said charge transport material is at least one compound selected from the group consisting of indoline compounds, quinoline compounds and triphenylamine compounds.

22. An electrophotoconductor according to claim 20, wherein said charge generation material is selected from the group consisting of perylene compounds and bisazo compounds.

23. An electrophotoconductor according to claim 21, wherein said indoline compound is represented by the formula

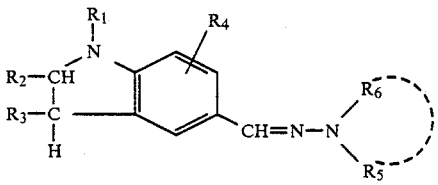

wherein $R_1$ is selected from the group consisting of hydrogen, alkyl, aralkyl is substituted aralkyl, aryl and substituted aryl; $R_2$ and $R_3$ are each independently selected from the group consisting of hydrogen, halogen, alkyl, aralkyl, substituted aralkyl, aryl and substituted aryl; $R_4$ is selected from the group consisting of hydrogen, halogen, alkyl, aralkyl and substituted aralkyl; $R_5$ and $R_6$ are each independently selected from the group consisting of alkyl, aralkyl, substituted aralkyl, aryl and substituted aryl, and $R_5$ and $R_6$ may be bonded to each other to form a ring.

24. An electrophotoconductor according to claim 21, wherein said indoline compound is represented by the formula:

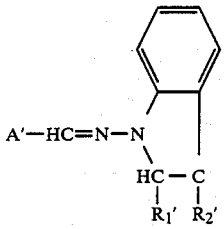

wherein A is selected from the group consisting of aromatic hydrocarbon, substituted aromatic hydrocarbon, aromatic heterocyclic and substituted aromatic heterocyclic; and $R_1'$ and $R_2'$ are each independently selected from the group consisting of hydrogen, halogen, alkyl, aralkyl, substituted aralkyl, aryl and substituted aryl.

25. An electrophotoconductor according to claim 21, wherein said quinoline compound is represented by the formula:

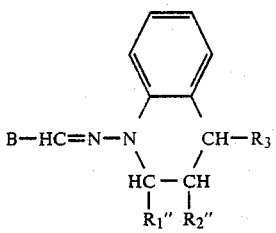

wherein B is selected from the group consisting of aromatic hydrocarbon, substituted aromatic hydrocarbon, aromatic heterocyclic and substituted aromatic heterocyclic; $R_1''$, $R_2''$ and $R_3''$ are each independently selected from the group consisting of hydrogen, halogen, alkyl, aralkyl, substituted aralkyl, aryl and substituted aryl.

26. An electrophotoconductor according to claidm 21, wherein said triphenalamine compound is represented by the formula:

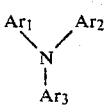

wherein $Ar_1$, $Ar_2$ and $Ar_3$ are each independently selected from the group consisting of aromatic hydrocarbon, substituted aromatic hydrocarbon, aromatic heterocyclic and substituted aromatic heterocyclic.

27. An electrophotoconductor according to claim 22, wherein said perylene compound is represented by the formula:

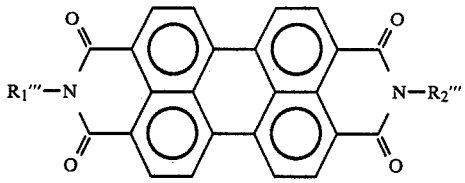

wherein $R_1'''$ and $R_2'''$ is each independently selected from the group consisting of hydrogen, alkyl, aryl, substituted aryl, and amino.

28. An electrophotoconductor according to claim 22, wherein said perylene compound is represented by the formula:

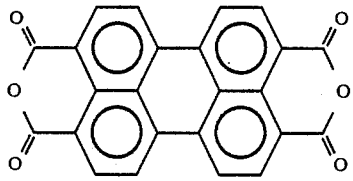

29. An electrophotoconductor according to claim 22, wherein said bisazo compound is represented by the formula:

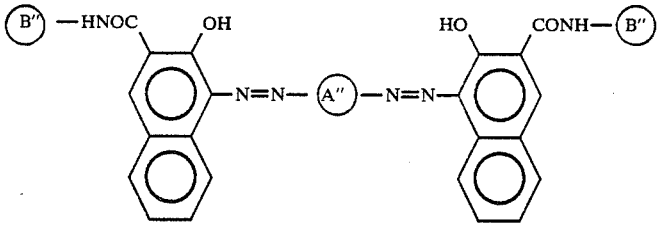

wherein — A″ — is a divalent conjugated organic group; and — B″ is a monovalent organic group.

30. An electrophotoconductor according to claim 22, wherein said bisazo compound is represented by the formula:

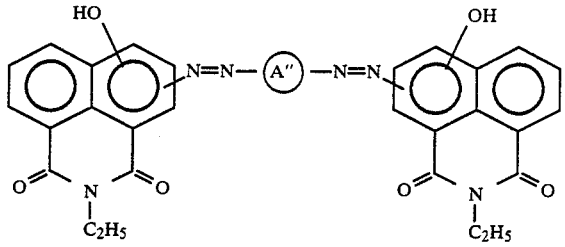

wherein — (A″) — is a divalent conjugate organic group.

31. An electrophotoconductor according to claim 22, wherein said bisazo compound is represented by the formula:

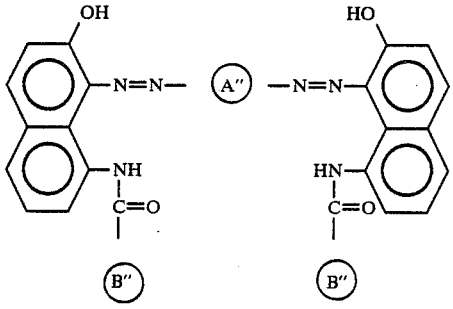

— A″ — is a divalent conjugate organic group; and
— B″ is a monovalent organic group.

* * * * *